US006207627B1

(12) United States Patent
Gates et al.

(10) Patent No.: US 6,207,627 B1
(45) Date of Patent: Mar. 27, 2001

(54) OXYGEN-CONTAINING ORGANIC COMPOUNDS AS BOUNDARY LUBRICANTS FOR SILICON NITRIDE CERAMICS

(75) Inventors: Richard S. Gates, Ijamsville; Stephen M. Hsu, Darnestown, both of MD (US)

(73) Assignee: The United States of America as represented by the Secretary of Commerce, Washington, DC (US)

( * ) Notice: Subject to any disclaimer, the term of this patent is extended or adjusted under 35 U.S.C. 154(b) by 0 days.

(21) Appl. No.: 08/184,172

(22) Filed: Jan. 19, 1994

(51) Int. Cl.[7] ..... C10M 129/04; C10M 129/16

(52) U.S. Cl. ..... 508/577; 508/580; 508/584; 508/542; 508/558

(58) Field of Search ..... 252/45, 32.7 E, 252/33, 56 R, 52 R

(56) References Cited

U.S. PATENT DOCUMENTS

| | | | | |
|---|---|---|---|---|
| 2,868,671 | | 1/1959 | Henricks | 252/12.2 |
| 3,850,820 | | 11/1974 | Korshak et al. | 252/12 |
| 3,878,113 | | 4/1975 | Campbell et al. | 252/12 |
| 4,134,842 | | 1/1979 | Orkin et al. | 252/12.6 |
| 4,371,445 | | 2/1983 | Faigle | 252/12 |
| 4,376,710 | | 3/1983 | Gardos et al. | 252/12.4 |
| 4,541,984 | | 9/1985 | Palmer | 376/415 |
| 4,575,430 | | 3/1986 | Periard et al. | 252/12.6 |
| 4,623,590 | | 11/1986 | Hodes et al. | 428/408 |
| 4,629,707 | | 12/1986 | Wolfe | 501/97 |
| 4,798,771 | | 1/1989 | Vogel | 428/564 |
| 4,826,612 | | 5/1989 | Habeeb et al. | 252/32.7 E |
| 5,133,804 | * | 7/1992 | Culpon, Jr. | 106/38.24 |
| 5,288,432 | * | 2/1994 | Jung | 252/56 S |
| 5,344,577 | * | 9/1994 | Deckman et al. | 252/45 |
| 5,407,601 | * | 4/1995 | Furey et al. | 252/52 R |

OTHER PUBLICATIONS

Hattori et al., 56th Ann Mtg of Chem Soc Abstracts, vol. I, 1988, p. 79.

Jahanmir, "Friction and Wear of Silicon Nitride Lubricated by Humid Air, Water, Hexadecane . . . ", ASME/ASL Conf., Oct. 20–22, 1986.

Hibi et al., Friction and Wear of Silicon Nitride in Water, n–Alcohols Water–Methanol and Water–Glycol, No. 53 1990, Bull of Mech Eng Lab.

Tsunai et al., "Tribochemical Wear of Silicon . . " pp. 369–374. (Date Unavailable).

Gates et al., "Effect of Selected Chemical Compounds on the Lubrication of Silicon Nitride", ASME/STLE Conf. Oct. 8–19, 1990.

P. Willermet, "An Evaluation of Several Metals and Ceramics in Lubricated Sliding", ASLE Transactions, vol. 30, pp. 128–120. (1987).

E.E. Klaus, "Lubricated Wear of Silicon Nitride", Lubrication Engineering, vol. 17, 8, pp. 679–684. (1990).

Stephen M. Hsu, Boundary Lubrication of Materials, MRS Bulletin/Oct. 1991, pp. 54–58.

J.J. Habeeb, "Wear and lubrication of ceramics", IMechE Conf. 1987.

* cited by examiner

*Primary Examiner*—Ellen M. McAvoy
(74) *Attorney, Agent, or Firm*—Millen White Zelano and Branigan

(57) ABSTRACT

Oxygen-containing compounds, particularly compounds wherein the oxygen is present in OH-groups, such as alcohols, sulfonic and carboxylic acids, or metal salts thereof, serve as lubricants for ceramic materials, particularly silicon nitride materials under high stress and high load conditions.

15 Claims, 3 Drawing Sheets

OXYGEN-CONTAINING ORGANIC COMPOUNDS AS BOUNDARY LUBRICANTS FOR SILICON NITRIDE CERAMICS

BACKGROUND OF THE INVENTION

This invention relates to a method of lubricating silicon nitride ceramics and the like.

Advanced ceramics offer great potential for future engineering applications. Their unique blend of strength, wear and corrosion resistance and light weight enables technologies that were not possible otherwise. Technologies such as low heat rejection engines, advanced gas turbines, environmentally compatible fuel efficient diesel engines, and space structures all depend on the availability of such advanced materials. The brittleness of ceramics, however, causes concern in terms of reliability and durability, especially since effective reliable lubrication technology of ceramics does not currently exist. This limits the load carrying capacity of the ceramics and durability of the ceramic component.

Silicon nitride, e.g., $Si_3N_4$, is the most promising ceramic for future applications in bearings, tools and engine components. The ability to lubricate these materials under high stress (boundary) conditions will become critical as the technology continues to mature.

In general, conventional lubricants rely on special chemical compounds to reduce friction and wear under high stress (boundary) conditions. One of the key concepts in boundary lubrication is that chemical reactions occur with the surface to produce a protective film. This is described in an article by S. M. Hsu, "Boundary Lubrication of Materials," MRS Bulletin, October 1991, pp. 54–58.

Many of the concepts of boundary lubrication on metal surfaces rely on chemical reaction with the metal surface and/or catalysis by the metal. This is easily understood because most metal system are chemically reactive. Current lubricants for iron-based systems are based on the reactions between P, S and Cl with iron. The resultant protective boundary lubricating films are rich in iron-organo-metallic compounds containing P, S and Cl.

Ceramic materials, however, contain substantially no iron (less than 0.2%). Further, ceramic materials are generally not considered to be reactive, relative to iron-based systems. In fact, ceramics are used in many applications because they are considered to be chemically inert and are thus, useful in high temperature and corrosive environments. Consequently, iron chemistry with conventional antiwear compounds would not be expected to be applicable to boundary layer lubrication of ceramic materials, such as silicon nitride.

Furthermore, one of the key roles of boundary lubricants in metal systems is to serve as a barrier film separating the two surfaces to prevent adhesion—a dominant wear mechanism in metal systems. Ceramic systems, on the other hand, are dominated by brittle fracture as a dominant wear mechanism. The mechanical strength, surface morphology, and film thickness for ceramics therefore are different from metal systems. To minimize fracture in ceramics, the dominant role of the lubricating films is to redistribute the asperity stresses in a contact. Therefore, the film should be thicker, stronger in shear strength, and faster reacting than films for metal systems. The distinction in the nature of wear mechanisms between metal systems and ceramic systems further supports the expectation that conventional concepts of boundary lubrication for metal systems would not be applicable to ceramic systems.

Prior art addressing the issue of $Si_3N_4$ lubrication is sparse and inconclusive. Willermet used several material pairs (cast iron/cast iron, steel/steel, $Si_3N_4$) and a pair of formulated lubricants to show that an oil soluble molybdenum containing compound reduced friction in an LFW-1 bench test for all material pairs, P. Willermet, "An Evaluation of Several Metals and Ceramics in Lubricated Sliding," ASLE Transactions, 30, 1, pp. 128–130, 1987. The oils were both SAE 30 with Zn dithiophosphate antiwear additive and an overbased detergent package containing Mg and boron. No wear data were provided. Klaus used a Ball-on-Three-Flat (BTF) wear tester to examine the performance of a SAE 5W-30 commercial oil on $Si_3N_4$ specimens. He found that at 40 kg applied load, the formulated oil had lower wear than a straight mineral oil. It was not determined which components in the commercial oil were responsible for the lower wear, E. E. Klaus et al., "Lubricated Wear of Silicon Nitride," Lubrication Engineering, 47, pp. 679–687, 1991.

As to oxygen-containing compounds, Jahanmir, "Friction and Wear of Silicon Nitride Lubricated by Humid Air, Water, Hexadecane and Hexadecane+0.5 Percent Stearic Acid", STLE Transaction, 31, pp. 32–43 (1988), indicated that 0.5% stearic acid in hexadecane under low load reduced the wear of $Si_3N_4$, however, no experimental evidence was offered to link direct chemical reaction with $Si_3N_4$. Indeed, Habeeb, *I. Mech. E C*132/87, p. 555–564 (1987), found that 0.4% lauric acid in a 150 neutral base oil increased the wear of $Si_3N_4$. Tsunai "Tribochemical wear of silicon Nitride in Water, n-Alcohols and Their Mixtures", *Wear of Materials,* p. 369–374 (1989) suggested that alcohols might react with $Si_3N_4$ and SiC for lubrication, however, experiments were conducted only at unrealistically low sliding speeds of 0.002 m/s, and the chemicals were limited to linear alcohols of carbon number 10 or less. The proposed mechanism was based on a reaction study of $C_1$ to $C_3$ alcohols with $Si_3N_4$ performed by Hattori, "Reactions of Silicon Nitride with Alcohols", the 56th Annual Meeting of Chem. Soc. Japan, Abstract, Vol. I, Tokyo, p. 790, April 1988, who did not present clear experimental evidence to support his proposal. Tsunai used Hattori's speculation on reaction mechanism even though Tsunai was unable to find the same reaction products in his wear tests. See also Hibi "Friction and Wear of Silicon Nitride in Water, n-Alcohols, Water-Methanol and Water-Glycol, "Bulletin of Mechanical Engineering Laboratory", No. 53 (1990).

Attention is also directed to Gates et al., "Effect of Selected Chemical Compounds on the Lubrication of Silicon Nitride," Tribology Transactions, 34, 3, pp. 417–425 (1991), which discloses that certain specific compounds show a lubrication effect upon silicon nitride.

SUMMARY OF THE INVENTION

An object of this invention, therefore, is to provide novel lubricants which are effective under boundary lubrication conditions, and a method of utilizing such lubricants for the lubrication of silicon nitrides and the like.

Upon further study of the specification and appended claims, further objects and advantages of this invention will become apparent to those skilled in the art.

To attain the objects of this invention, there are provided alcohol compounds that can serve as effective lubricants for silicon nitrides under high stress and high load conditions, commonly referred to as the boundary lubrication regime.

Tests conducted on a ball-on-three-flat wear tester under boundary lubrication conditions demonstrate that additions of as little as, for example, 1.0% of these materials to a base oil reduced wear by over 90%.

The lubricants react with the silicon nitride materials to form boundary films which provide a lubricating effect.

Such lubrication offers significant benefits in developing ceramic technologies in which low ashing, alternate fuels-compatible lubricants are desired.

According to one aspect of the invention, there is provided a method of lubricating silicon nitrides in the boundary lubrication regime with alcohol compounds.

Preferred are aromatic alcohols of the formula (I):

(I)

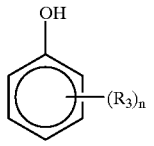

wherein the $R_3$ groups independently are hydroxy, alkyl of 1–15 carbons or a polyethoxy chain of 1 to 9 ethoxy units, and n is 1 or 2, provided that when $R_3$ is hydroxy n is 1. Particularly preferred are octylphenol having a polyethoxy chain of 1,4 or 9 ethoxy units, catechol (1,3-dihydroxybenzene) and 3-n-pentadecylphenol.

Also, polyaromatic alcohols are useful in the invention. For example, compounds of the formula (IA):

(IA)

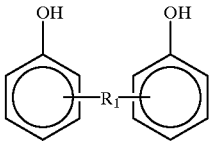

wherein $R_1$ is a long chain alkyl group of, for example, 8 to 18 carbon atoms, where the aromatic groups are substituted internally and/or at the ends of the alkyl group, preferably both aromatic groups being toward the same end. Particularly preferred for $R_1$ is a $C_{15}$-pentadecane group, such as 1,8-bis(hydroxyphenyl)pentadecane.

Also, preferred are alkanols or alkenols of 6 to 18 carbon atoms, particularly, linear primary alcohols, such as, for example, 1-hexanol, 1-octanol, 1-decanol, 1-dodecanol, 1-octadecanol and oleil alcohol.

A further class of alcohols useful as lubricants according to the invention are alkylaryl-polyether alcohols, for example, alcohols, having the formula (IIA):

(IIA)

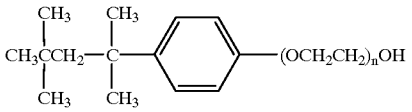

wherein n is 1–18, particularly 1, 5 or 9, and Triton N alcohols of the formula (IIB):

(IIB)

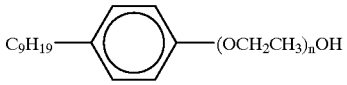

where n is 4–15.

Mannich reaction products, such as, for example, of the formula (VI):

(VI)

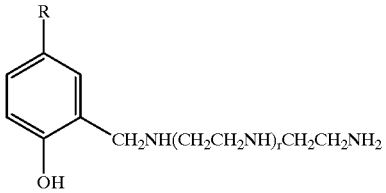

wherein r is from 1–4 and R is an alkyl chain consisting of 3 to 8 carbon atoms, are also effective lubricants for silicon nitrides.

These compounds are effective in admixture with a base oil, for example, purified paraffin oil (PPO) or the like. The organic compound is provided in the base oil in a lubricating-enhancing amount, the optimum concentration with respect to lubrication and cost being determined in each case by routine experimentation and calculations, in general, it is preferred for the concentration to be in the range of about 0.1 to 20 wt. % and preferably in the range of 1–3 wt. %.

In addition to being useful in minor amounts in base oils, the alcohol compounds described above can be used "neat", i.e. in substantially pure form, directly as the lubricant for silicon nitride ceramics, or in any amount between the minimum suitable to provide a lubricating effect, for example, 1% and 100%.

These alcohol compounds are effective at bulk fluid temperatures in the range of 0° C. to their boiling points, preferably at room temperature, and in the boundary lubrication regime.

EXPERIMENTAL APPARATUS AND PROCEDURES

Figure 1:
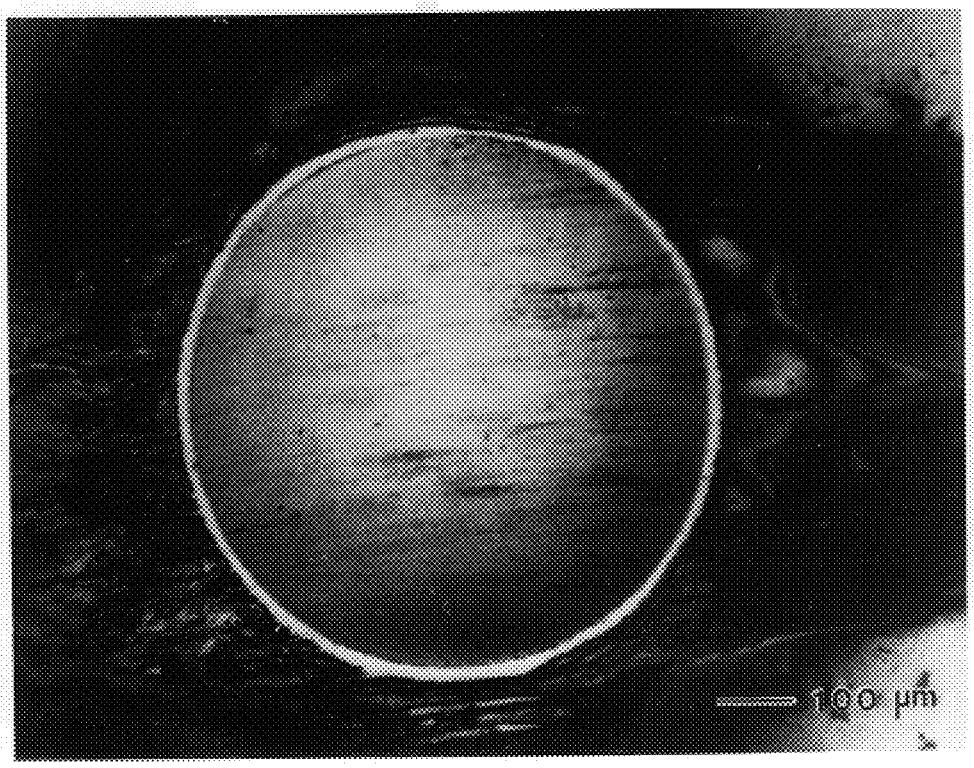
FIG. 1 is an optical micrograph of a wear scar on a test ball when PPO is used as lubricant.

Wear tests were conducted using a ball-on-three-flat (BTF) modification of a four-ball wear tester. This configuration replaces the lower three ball specimens with 6.35 mm (0.25 in) diameter, 1.59 mm (0.0625 or 1/16 in) thick disks. The advantage of this configuration is that tests can be conducted using only one of the relatively difficult to fabricate 12.7 mm (0.5 in) diameter balls. Disks are easily made from 6.35 mm diameter rod stock of the selected ceramic material using a sequence of diamond cutting, grinding, and polishing steps. Specimens were cleaned just prior to testing using a sequence of solvents of hexane, acetone, detergent ("Micro") in 18 MΩ deionized (DI) water, and pure DI water. Wear tests were conducted at conditions of 60 kg applied load (240 N normal load), 0.23 m/s (600 rpm), 30 minute duration, and 21° C.

Wear was measured at the end of the test using an optical microscope with a calibrated graduated reticle. Each of the wear scars were measured parallel to and perpendicular to the direction of sliding. The resulting six measurements were averaged to give the wear scar diameter for the test.

Friction was continuously monitored throughout each test by a force transducer with output to a strip chart recorder and personal computer. The value reported for the coefficient of friction is the steady-state value obtained at the end of the test.

Specimens were cleaned just prior to testing by soaking them in solvents and ultrasonically agitating them for 10 seconds. The solvent sequence used was hexane, acetone, 5% laboratory detergent in deionized water and pure 18 MΩ deionized water. After each ultrasonic soaking, the specimens were rinsed twice with the same solvent. After the final water rinse, the specimens were dried with nitrogen gas.

A detailed description of the friction type (I–III) terminology used in this paper is described in the Gates et al. article cited above. Type I represents poor lubrication. Friction immediately rises to relatively high levels. This behavior is associated with high wear. Type II friction represents good lubrication. Friction is low and steady throughout the test. This behavior is associated with low wear. Type III friction starts out low and becomes high during the test. This behavior is associated with high wear and is considered to indicate initial good lubrication with a transition to poor lubrication some time during the test. This type of friction indicates a lubricant that is close to its limit of effectiveness. Under slightly lower severity the lubricant may be more effective.

Materials

The monolithic $Si_3N_4$'s used for this study were commercially available, fully dense materials known as NC132 and NBD 100. These two materials start from the same powder processing step but differ in their heat treatment to form the final dense $Si_3N_4$. NC132 is hot pressed, while NBD100 is HIP'd (Hot Isostatically Pressed). For the purpose of these tests, there is no significant difference between the wear properties of these two materials.

Chemical compounds used in these tests were obtained commercially in as pure a form as was available. For example, the octanol used for many of the wear tests had a purity better than 99.5%.

The base oil used in this study was a ≈27 Cst (measured at 37.7° C. or 100° F.) paraffinic oil purified by percolating it through 200 mesh activated alumina. This resulted in a purified paraffin oil (PPO) free of polar impurities that might affect the wear results.

Wear Test Results and Discussion

Results of wear tests conducted according to the above-described procedures using as lubricants 1% of selected alcohol compounds added to a purified paraffin oil (PPO) are summarized in Table 1.

Figure 2:
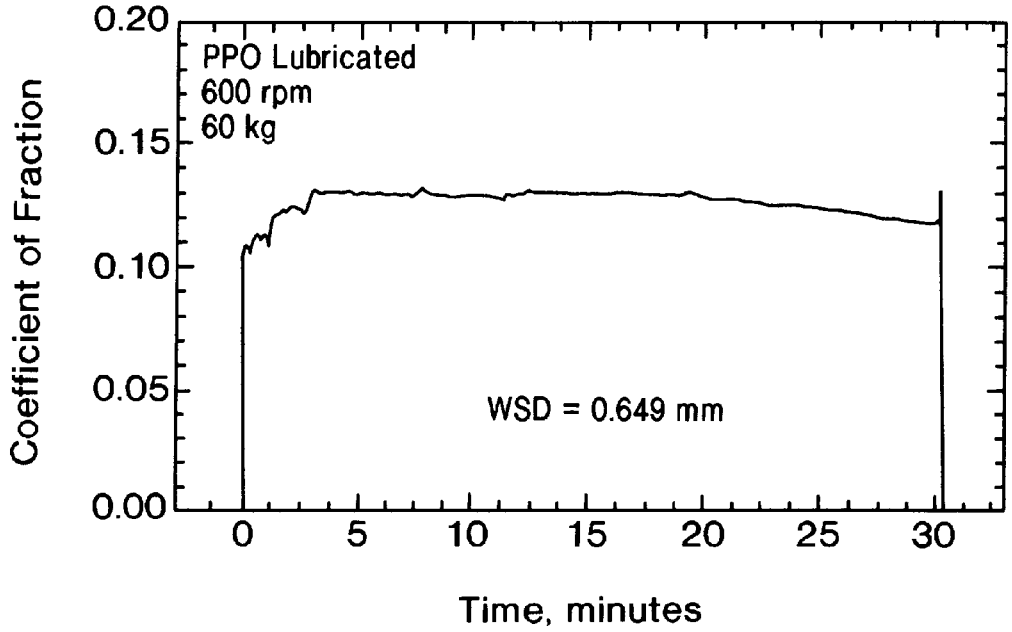
FIG. 2 is a graph of the coefficient of friction over time for a wear test with PPO as lubricant.

PPO itself exhibits some, limited, boundary-lubricating ability with $Si_3N_4$, but only at relatively low loads of 20 to 30 kg in the BTF test. Under the higher severity of 60 kg, PPO exhibits high friction and wear as shown in the optical micrograph of FIG. 1 and friction trace of FIG. 2. An immediate increase to higher friction is observed (type I friction) and wear is high. The optical micrograph reveals that the wear scar is smooth and symmetric. The small striated discolorations within the wear scar suggest a micro-abrasion process by opposing asperities. These discolorations are brownish and are reminiscent of oxidized organic compounds often seen inside the wear scars of paraffin oil lubricated wear tests on iron-based metals. A substantial amount of deposit is observed surrounding the wear scar in a pattern that indicates the flow field for the lubricant (and wear products) during the wear test. The high molecular weight, organic, nature of the deposit was confirmed using gel permeation chromatography and FTIR.

Esters had no beneficial effect at 1% in PPO. These included ethyl stearate, a polyol ester, and two dibasic acid esters. The polyol ester and the alkyl dibasic acid ester (bis(2-ethylhexyl)sebacate) actually gave much higher wear than neat PPO.

Significant antiwear effect was exhibited by several alcohol compounds, including aromatic alcohols (mannich product and 3-n-pentadecyl phenyl). In these cases, wear was low, friction was low and of type II behavior, and films were observed in the wear scar. When the hydroxyl group is sterically hindered as in the aromatic alcohol 2,6-ditertiarybutyl-p-cresol, no lubricating effect is observed.

Several compounds were tested neat, i.e., in substantially pure form. The results of the these tests, shown in Table 2, indicate that several neat alcohols can provide lower friction and wear than the neat PPO.

The friction coefficients of ≈0.05 observed for some of the alcohol compounds is very low for such a severe wear test in which the initial mean Hertzian pressures exceed 2.1 GPa (300,000 psi), and suggest an elastohydrodynamic component of lubrication may play a partial role in the lubrication process. The ether and ester compounds were not effective neat.

Figure 3:
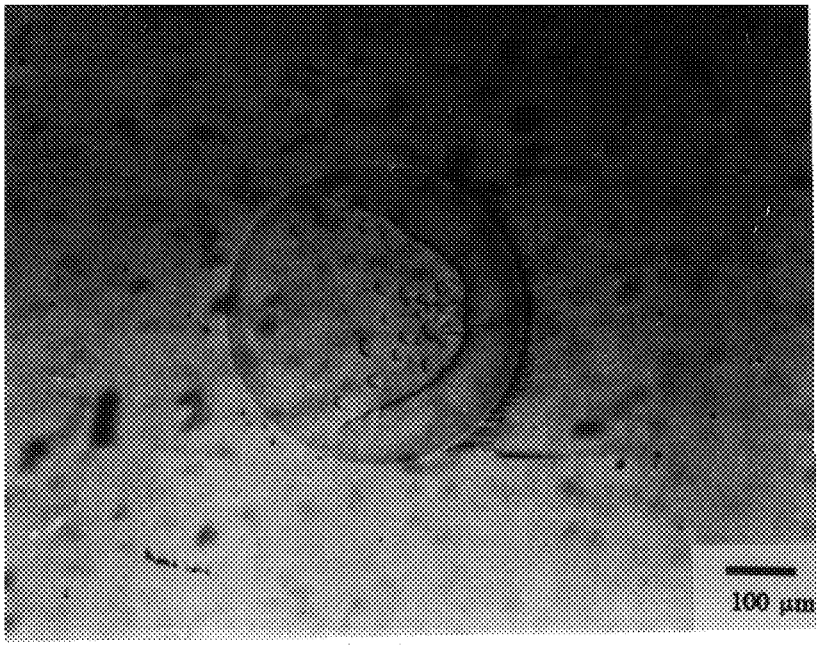
FIG. 3 is an optical micrograph of a wear scar on a test ball when oleil alcohol is used as lubricant.

One striking feature of many of the anti-wear alcohols was the wear scar morphology, as exemplified by oleil alcohol in FIG. 3. The direction of sliding in this optical micrograph is from left to right. There is a wedge-shaped region on the entrance side, and a smooth, horseshoe-shaped region on the exit side. Surface profilometry confirmed that the wedge is projecting out of the wear scar surface. The horseshoe-shaped region is therefore a deeper, trough in the wear scar. Its smoothness suggests a chemical polishing has taken place in this high stress, high temperature region of the wear scar.

Table 3 shows the results of wear tests using neat solutions of a series of three long-chain alcohols known as Triton surfactants. These compounds have the advantage of being both higher molecular weight, and liquids at room temperatures, because of their mixed alkyl/aryl chemical structure. All of the these alcohols were successful, with longer chains being more effective. Also the final coefficient of friction decreases with increasing chain length.

Figure 5:
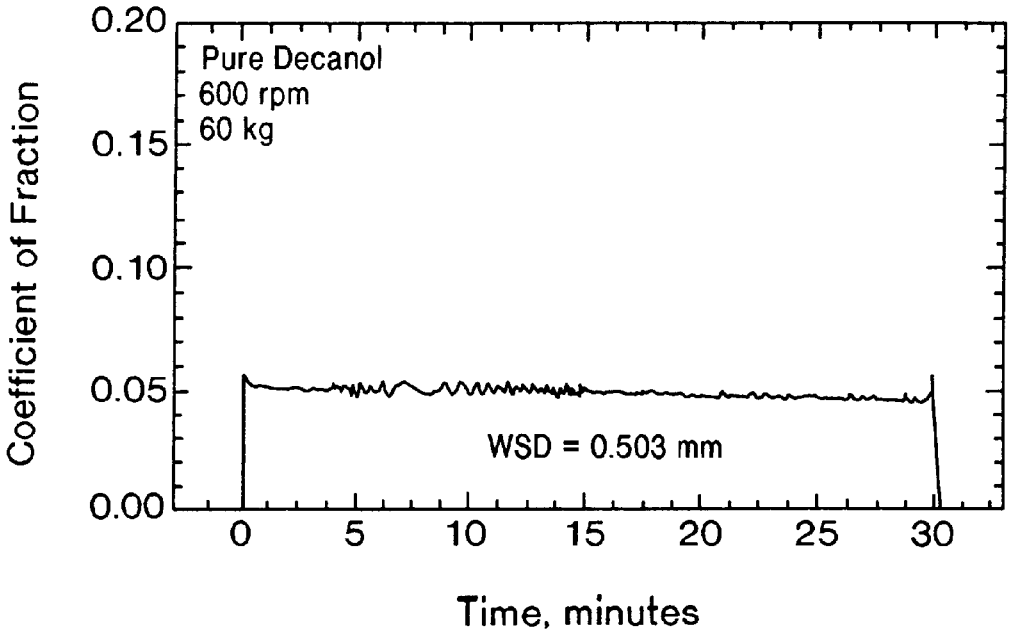
FIG. 5 is a graph of the coefficient of friction vs. time for a wear test with decanol as lubricant.
Figure 4:
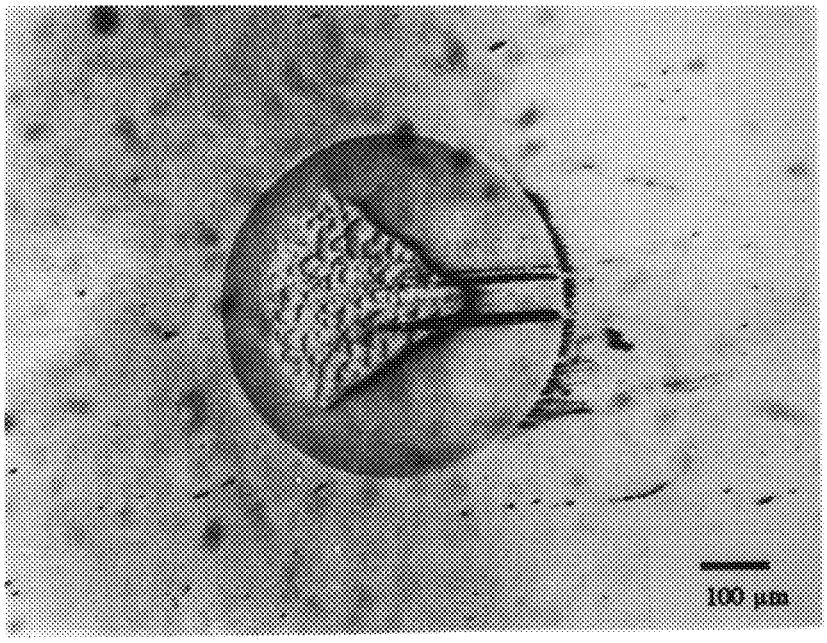
FIG. 4 is an optical micrograph of a wear scar on a test ball when decanol is used as lubricant.

Table 4 summarizes the data on the described wear tests on neat solutions of primary alcohols. The wedge-shaped regions seen in the wear scars of the other neat alcohol-lubricated tests were also visible here. See FIGS. 4 and 5, showing an optical micrograph of the wear scar using decanol as lubricant and the coefficient of friction trace therefore. In this case, the smaller chain length alcohols had larger wear scars, but smaller wedge-shaped regions. The fact that the wedge-shaped region got smaller as chain length decreased suggests that there is some relationship between chain length, wedge-shaped region and lubrication effectiveness. Attempts to remove this wedge-shaped region using solvents were not successful. Even acids (including HF) could not remove this feature from the wear scar. Finally, Auger analysis with depth profiling was used to show that this feature and the surrounding surface were identical in composition with depth, leading to the conclusion that the wedge-shaped feature is merely unworn silicon nitride. The shiny horseshoe-shaped region at the trailing part of the wear car is in fact a region of higher wear. This reinforces the hypothesis that some form of reaction and chemical polishing has occurred.

To study the effects of differing functional groups, a series of eight-carbon compounds with different functional groups were tested to directly compare effectiveness. The results are shown in Table 5. 1-Octanol was the most effective. A secondary alcohol (2-octanol) was only effective for a few minutes, as was octanoic acid. The octyl ketone and aldehyde were not effective.

The advantageous level of friction observed with the alcohol lubricants of the invention is not often seen in boundary lubrication. These observations and the low viscosity of many of the compounds used suggest that a component of elastohydrodynamic lubrication is a contributing factor. Although not intending to be bound by this theory, it is hypothesized that the elastohydrodynamic contribution proceeds to lubrication through a combination of viscous reaction product film forming and surface smoothing to reduce surface roughness. Indeed smooth, worn areas in the higher temperature exit region of the wear scars have been observed for alcohol-lubricated $Si_3N_4$. This suggests that chemical polishing is occurring through direct chemical reaction between the $Si_3N_4$ surface and the alcohol compounds. For example, the low load boundary-lubricating ability of $Si_3N_4$ by paraffin oil can be explained in the light of these results. The high temperature generated by friction results in oxidation of the paraffin oil to provide carboxylic acids and alcohols. These alcohols can then provide (limited) boundary lubrication protection.

TABLE 2-continued

Summary of neat Oxygen-Containing Compound BTF Wear Test Data

| COMPOUND | WSD (mm) | WSD Incr[1] (mm) | Final COF | Frict Type |
|---|---|---|---|---|
| Polyphenyl Ether | 0.733 | 0.353 | 0.095 | I |
| Bis (2-ethylhexyl) Sebacate | 0.919 | 0.539 | 0.148 | I |

[1]Wear Scar Diameter Increase above the Hertzian Contact diameter (0.380 mm)
[2]Average of 16 tests

TABLE 3

Summary of Neat Alkylarylpolyether Alcohol BTF Wear Test Data

| Compound | WSD (mm) | WSD Incr[1] (mm) | Final COF |
|---|---|---|---|
| PPO[2] | 0.645 | 0.265 | 0.117 |
| Alkylarylpolyether (n = 9) | 0.420 | 0.040 | 0.067 |
| Alkylarylpolyether (n = 5) | 0.465 | 0.085 | 0.073 |
| Alkylarylpolyether (n = 1) | 0.528 | 0.148 | 0.081 |

[1]Wear Scar Diameter Increase above the Hertzian Contact diameter (0.380 mm)
[2]Average of 16 tests
n Refers to the number of ethoxy "mer" units comprising the ether side chain.

TABLE 1

Friction and Wear Data on Selected Oxygen-Containing Model Compounds at 1% in Paraffin Oil

| Chemical Compound[1] | WSD (mm) | Dia increase above Hz. mm | COF[2] | Frict. Type[3] | Wear Scar Appearance | Film in Scar ? | Lubrication Classification |
|---|---|---|---|---|---|---|---|
| NONE (Average of 16 tests[4]) | 0.645 | 0.265 | 0.117 | I | smooth | no | Poor |
| 3-n-Pentadecyl Phenol | 0.402 | 0.022 | 0.071 | II | roughened | Yes - plastic | Good |
| Mannich Product | 0.402 | 0.022 | 0.088 | II | smooth | Yes - spotty | Good |
| 2,6-ditertiarybutyl-p-cresol | 0.661 | 0.281 | 0.123 | I | smooth | no | Poor |
| Bis (2-ethylhexyl) Phthalate | 0.678 | 0.298 | 0.134 | III (2) | smooth | no | Temporary |
| Ethyl Stearate | 0.696 | 0.316 | 0.120 | III (3) | smooth | no | Temporary |
| Bis (2-ethylhexyl) Sebacate | 0.729 | 0.349 | 0.129 | III (2) | smooth | no | Temporary |
| Polyol Ester | 0.749 | 0.369 | 0.134 | I | smooth | no | Poor |

[1]1 wt % in purified paraffin oil
[2]Measured at the end of the test
[3]Number in parenthesis indicates time to friction transition in minutes
[4]Repeatability of wear scar measurement: 0.645 ± 0.018; Repeatability of friction coefficient measurement: 0.117 ± 0.010
WSD: Wear Scar Diameter
Hz: Hertzian contact diameter
All Tests conducted on at 600 rpm, 60 kg, 30 minutes, 1% additive in PPO, 21° C.

TABLE 2

Summary of neat Oxygen-Containing Compound BTF Wear Test Data

| COMPOUND | WSD (mm) | WSD Incr[1] (mm) | Final COF | Frict Type |
|---|---|---|---|---|
| PPO[2] | 0.645 | 0.265 | 0.117 | I |
| Oleil Alcohol | 0.429 | 0.049 | 0.049 | II |
| $C_{18}OH$ (75° C.) | 0.495 | 0.115 | 0.046 | II |

TABLE 4

BTF Wear Test Results on Primary Linear Alcohols

| Alcohol | WSD (mm) | WSD Incr[1] (mm) | Final COF |
|---|---|---|---|
| Decanol | 0.503 | 0.123 | 0.045 |
| Octanol | 0.557 | 0.177 | 0.049 |
| Hexanol | 0.633 | 0.253 | 0.051 |

[1]Wear Scar Diameter Increase above the Hertzian diameter (0.38 mm)

TABLE 5

Summary of Neat $C_8$ Series Oxygen-Containing Compound BTF Wear Test Data

| Compound | WSD (mm) | WSD Incr[1] (mm) | Final COF | Frict. Type[2] |
|---|---|---|---|---|
| PPO* | 0.645 | 0.265 | 0.117 | I |
| 1-Octanol | 0.557 | 0.177 | 0.049 | II |
| 3-Octanone | 0.970 | 0.590 | 0.175 | I |
| Octanoic Acid | 1.068 | 0.688 | 0.187 | III (1) |
| 2-Octanol | 1.076 | 0.696 | 0.126 | III (6) |
| Octyl Aldehyde | 1.250 | 0.870 | 0.141 | I |

[1]Wear Scar Diameter Increase above the Hertzian Contact diameter (0.380 mm)
[2]Number in parenthesis indicates time to friction transition in minutes.
*Average of 16 tests From the foregoing description, one skilled in the art can easily ascertain the essential characteristics of this invention, and without departing from the spirit and scope thereof, can make various changes and modifications of the invention to adapt it to various usages and conditions.

What is claimed is:

1. A method for lubricating a silicon nitride ceramic surface which comprises:

applying to the silicon nitride ceramic surface a composition comprising an alcohol compound, in an amount sufficient to provide a lubricating effect, wherein said alcohol has lubricating activity and is other than an alkanol, a glycol or 2,6-ditertiarybutylcresol.

2. The method of claim 1, wherein the composition further comprises a base oil.

3. The method of claim 2, wherein the base oil is purified paraffin oil (PPO).

4. The method of claim 1, wherein the composition contains a base oil and the alcohol compound is present in an amount of 0.1 to 20 weight percent of the composition.

5. The method of claim 1, wherein the composition contains a base oil and the alcohol compound is present in an amount of 1.0 to 3.0 weight percent of the composition.

6. The method of claim 4, wherein the base oil is purified paraffin oil (PPO) and the composition consists essentially of the base oil and the alcohol compound.

7. The method of claim 1, wherein the composition consists essentially of the alcohol compound.

8. The method of claim 1, wherein the composition is applied under boundary lubrication conditions.

9. A method for lubricating a silicon nitride ceramic surface which comprises:

applying to the silicon nitride ceramic surface a composition comprising an alcohol compound, in an amount sufficient to provide a lubricating effect, wherein said alcohol compound is selected from the group consisting of:

an aromatic alcohol of the formula (I), (I)

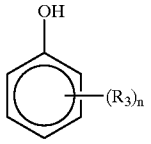

wherein $R_3$ is independently hydroxy, alkyl of 1–15 carbon atoms or a polyethoxy chain of 1 to 9 ethoxy units, and n is 1 or 2, provided that when $R_3$ is hydroxy n is 1;

an alkenol of 6–18 carbon atoms;

an alcohol of the formula (IIA), (IIA)

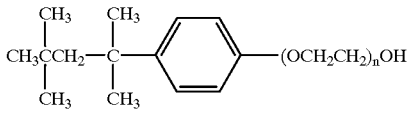

wherein n is 1–18;

an alcohol of the formula (IIB), (IIB)

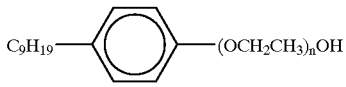

wherein n is 4–15;

a Mannich reaction product of the formula (VI), (VI)

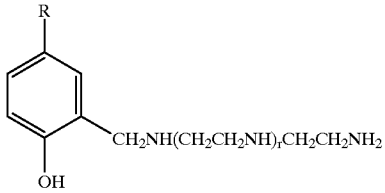

wherein R is alkyl of 3–8 carbon atoms and r is 1–4; and mixtures thereof.

10. The method of claim 9, wherein the alcohol compound is an aromatic alcohol of the formula (I), (I)

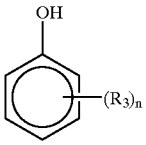

wherein $R_3$ is independently hydroxy, alkyl of 1–15 carbon atoms or a polyethoxy chain of 1 to 9 ethoxy units, and n is 1 or 2, provided that when $R_3$ is hydroxy n is 1.

11. The method of claim 9, wherein the alcohol compound is an alkenol of 6–18 carbon atoms.

12. The method of claim 9, wherein the alcohol compound is an alcohol of the formula (IIA), (IIA)

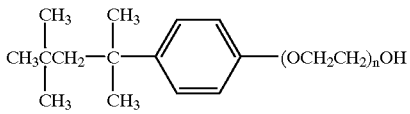

wherein n is 1–18.

13. The method of claim 9, wherein the alcohol compound is an alcohol of the formula (IIB), (IIB)

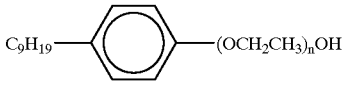

wherein n is 4–15.

14. The method of claim 9, wherein the alcohol compound is a Mannich reaction product of the formula (VI), (VI)

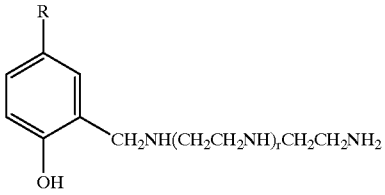

wherein R is alkyl of 3–8 carbon atoms and r is 1–4.

15. A method for lubricating a silicon nitride ceramic surface which comprises:

applying to the silicon nitride ceramic surface a composition comprising an alcohol compound, in an amount sufficient to provide a lubricating effect, wherein said alcohol compound is selected from the group consisting of:

octylphenol having a polyethoxy side chain of 1, 4 or 9 ethoxy units; 1,3-dihydroxybenzene; 3-n-pentadecylphenol; 1-oleil alcohol; an alkylaryl polyether of the formula (IIA) wherein n is 1, 5 or 9, and mixtures thereof.

* * * * *